United States Patent [19]

Lödige et al.

[11] 3,945,616

[45] Mar. 23, 1976

[54] DEVICE FOR MIXING FLOWABLE MATERIAL SUCH AS ADHESIVE WITH PARTICULATE MATERIAL

[76] Inventors: Wilhelm Lödige, Elsener Str. 9C; Fritz Lödige, Leuschner Str. 12; Josef Lucke, Im Lohfeld 13, all of 479 Paderborn, Germany

[22] Filed: Mar. 27, 1974

[21] Appl. No.: 455,290

[52] U.S. Cl. ..... 259/9; 137/561 A; 259/182

[51] Int. Cl.[2] ..... B01F 7/04; B01F 15/02

[58] Field of Search ..... 259/9, 10, 25, 26, 45, 259/46, 182; 137/561 A; 118/303

[56] References Cited

UNITED STATES PATENTS

| | | | |
|---|---|---|---|
| 2,163,591 | 6/1939 | Deverall | 137/561 A X |
| 2,559,516 | 7/1951 | Russel | 259/25 |
| 2,679,385 | 5/1954 | Lodige et al. | 259/9 |
| 3,162,428 | 12/1964 | Lodige et al. | 259/9 |
| 3,163,403 | 12/1964 | Engels | 259/9 |
| 3,175,578 | 3/1965 | Patterson et al. | 137/561 A |
| 3,734,471 | 5/1973 | Engels | 259/10 X |

FOREIGN PATENTS OR APPLICATIONS

| | | | |
|---|---|---|---|
| 1,202,479 | 10/1965 | Germany | 259/10 |

*Primary Examiner*—Robert W. Jenkins
*Assistant Examiner*—James A. Niegowski
*Attorney, Agent, or Firm*—Walter Becker

[57] ABSTRACT

A device for mixing glue or a like flowable substance with particulate material such as wood chips in which the chips are fed into one end of an elongated horizontal cylindrical chamber and are discharged from the other end while being caused to follow a rotary path in the chamber by a mixing member in the chamber having arms extending radially to near the periphery of the chamber. Glue feeding conduits extend into the chamber and into the ring of material therein between adjacent ones of said arms. The glue feeding conduits are connected in groups to manifolds and can be removed from the chamber in groups together with the respective manifold.

18 Claims, 7 Drawing Figures

IV'3

DEVICE FOR MIXING FLOWABLE MATERIAL SUCH AS ADHESIVE WITH PARTICULATE MATERIAL

The present invention relates to a device for applying glue to chips, fibers or similar mixed material of wood, bagasse or the like, especially cellulose-containing substances, with at least one cylindrical mixing chamber in which mixing tools rotate which cause the mixed material to rotate along the wall of the mixing chamber, and in which discharge openings of glue-feeding passages which pass from the outside through the cylindrical wall into the mixing chamber and in spaced relationship from the inner wall of the mixing chamber point to an area inside the circulating mixed material and in the circulating direction thereof. With this heretofore known device, the glue feed is provided at the entrance region of the first third of the length of the mixing chamber and also within the region of the outlet portion of the mixing chamber. Individual glue-feeding conduits are passed through the cylindrical mantle of the mixing chamber and feed the glue in a pressureless way into the ring for the mixing material.

This known device has the drawback that during the feed of the pressureless glue through the glue-feeding passages extending through the wall of the mixing chamber, within the region of the outer surface of the inner passage section, droplets form and glue particles get stuck which impede the gluing and from time to time drop off thereby mixing with the chip material and making the respective plywood plate or the like useless. A further disadvantage in this connection consists in that an intensive and uniform glue distribution is only under difficulties obtainable when the glue-feeding passages are arranged stationarily.

It is, therefore, an object of the present invention to provide a particularly intensive glue distribution when feeding the glue from the outside into the mixing chamber.

This object and other objects and advantages of the invention will appear more clearly from the following specification in connection with the accompanying drawings, in which:

FIG. 1 diagrammatically illustrates a longitudinal section through a glue-applying machine according to the invention.

Figure 6B:
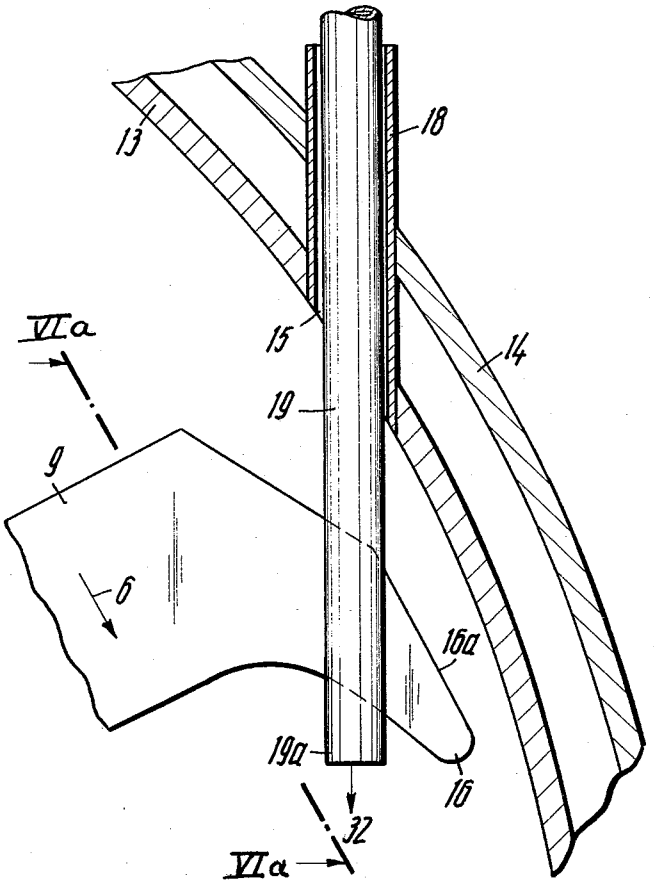
Figure 6A:
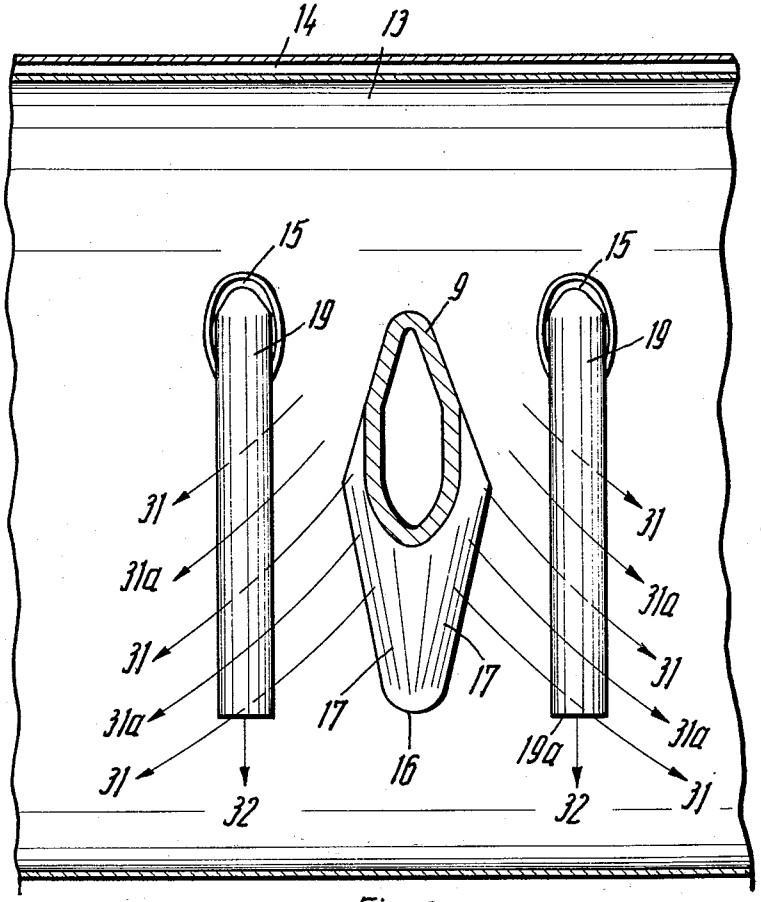

FIGS. 6*a* and 6*b* illustrate the device according to the invention while employing boot-shaped mixing tools, and more specifically, FIG. 6*a* is a section taken along the line VI*a*—VI*a* of FIG. 6*b*.

FIG. 6*b* shows a view of FIG. 6*a* as seen in the direction of the arrow VI*b* in FIG. 6*a*.

The device according to the present invention is characterized primarily in that in axial direction of the mixing chamber there are provided a plurality of serially arranged glue-feeding conduits while at least two adjacent glue-feeding conduits in axial direction of the mixing chamber are spaced from each other by a distance which is greater than the passage width of a mixing tool but is only of such a size that each of the two adjacent conduits is located within the region of the material to be mixed moved laterally of the mixing tool.

With this arrangement, the high circumferential speed of the ring of chip material which is brought about by the mixing tools is directly taken advantage of for discharging in an ejector-like manner the glue which flows into the mixer in a pressure-like manner. This ejector-like discharge is brought about by the suction effect exerted upon the discharge openings of the conduits so that also at a relatively high viscosity of the glue, without additional devices, but merely due to the finest chip particles which are circulated in the mixing material ring at high speed, a sufficient quantity of glue will be discharged. Simultaneously in view of the sideward movement of the material to be mixed, which movement is generated by the mixing tools, a distribution of the glue in width, i. e. in axial direction, is obtained without additional technical means and even without particular employment of energy. The mixing tools will during their passage narrow the space between two glue-feeding passages and simultaneously will displace the chip material which is located in said intermediate space and circulates annularly so that the chip material flows with a strong lateral component of movement around the feeding passages. In this way, the glue which is drawn out of the stationary feeding passages in a pressureless manner is distributed not only in circumferential direction but directly after its exit is immediately distributed laterally in the gluing zone onto the individual chip particles whereby the chip to chip friction between the material to be mixed in a compact ring is aided as it is necessary for a good glue application. Due to the fact that these glue-feeding passages are passed around in circulating direction and to the simultaneous periodic action upon the passage sections by the sidewardly directed currents of chips during the passing through of the mixing tools, a continuous self-cleaning of the passage or conduit sections protruding from the cylinder wall from glue particles which might crawl along said conduit sections will be effected. This brings about the advantage that the conduit sections which protrude from the cylinder wall and which are particularly exposed to the danger of crusting by the adherence of glue can continuously clean themselves so that also when the device is used continuously, the danger of the admixture of breaking-off particles of agglomerates and the danger adherent thereto that the entire plywood plate becomes useless will be avoided.

The lateral displacement of the material to be mixed according to the invention may be further increased by having at least those mixing tools. These tools pass between adjacent glue-feeding passages or conduits for obtaining a movement of component of the material to be mixed. This component acts laterally with regard to the circulating direction. On at least one side thereof there is at least one profile section which when viewed in of a section of mixing tool is greater than the adjacent narrowed minimum cross section of the mixing tool.

An optimum cleaning and mixing effect is obtained particularly when, as a preferred embodiment of the invention, at least those mixing tools which pass between adjacent glue-feeding passages or conduits have at least the approximate shape of a boot or a drop so that the tip of the boot points in circulating direction toward the front and the wall of the boot points toward the inner wall of the mixing chamber. During the rotation of a boot-shaped mixing tool which rotates at both sides of a glue-feeding conduit in view of this boot shape during the entry of the boot tip into the intermediate space between adjacent conduits and during a further immersion of the boot into said intermediate space, the material to be mixed is displaced laterally to such an extent that each lateral surface of the boot passes the material to be mixed to the respective adjacent glue-feeding conduit. As a result thereof, the glue-feeding conduit is passed around by a lateral component of movement of the material to be mixed, and the directly adjacent boot-shaped mixing tool will in opposite direction generate a lateral component of movement against the same glue-feeding conduit. It will thus be appreciated that when the boot-shaped mixing tools pass through, the respective feeding conduits between said mixing tools are subjected to currents of materials to be mixed of opposite direction, said currents bringing about an intensive and complete absorption of glue liquid which might have collected at the wall of the respective conduit or at the cylinder wall within said region. In this way, the forming of a crust on this endangered region of the walls will be safely avoided. Surprisingly, it has been found that with the boot-shaped design of the mixing tools according to the invention, the pressure of the ring of the material to be mixed on the cylindrical inner wall of the mixing chamber is less even though the wall of the boot-shaped mixing tool extends close to the inner wall of the mixing chamber. The boot-shaped design of the mixing tool according to the invention therefore has the advantageous effect that a portion of the material to be mixed as caught by the tip of the boot is moved away from the wall into the region around the inwardly protruding conduit so that an undesired accumulation of the material to be mixed in the region of the wall will be avoided.

The design of the passages in form of conduits has, as mentioned above, the advantage that in a simple manner a connection to an outer glue-feeding line will be possible. An increase in the supply of glue may in certain instances also be obtained by providing between each two mixing tools two or more glue-feeding conduits which are arranged adjacent to each other in the direction of the mixer axis. Over a cross-sectional increase of a conduit for increasing the glue supply in case of need, the arrangement of a plurality of the same type of conduits and of the same cross-sectional opening has the advantage that the flow behavior of the glue and thus the gluing characteristic is independent of the quantity of the fed glue because, depending on the requirement, more or less conduits will under otherwise the same conditions be in operation.

According to a simple structural design, the glue-feeding conduits are in the passages detachably guided by sleeves. This permits an easy exchange and a simple cleaning of the glue-feeding conduits. The checking of the glue supply is furthermore facilitated by the fact that for conveying the glue to the feeding conduits there is employed a transparent conduit which permits an observation of the glue supply in operation so that a clogging up or an accumulation of glue can immediately be observed.

It is particularly advantageous to supply the glue-feeding conduits from a distributing chamber, especially a distributor pipe having the design of a rake. Such a distributor pipe is uniformly supplied with glue due to the fact that it is connected to two or more feeder conduits, especially to the branch conduit of a forked central feeding pipe. A proper flow of the glue to the feeding pipe may also be assured by arranging the conduits in the upper half of the mixing chamber wall while said conduits are vertically arranged. The connection to the distributing chamber isadvantageously effected at the lowermost portion so that due to the shearing force and the suction effect of the rotating chip material, the feeding of the glue from the distributing chamber is not primarily dependent on the pressure in the feeding conduit and thus the glue feeding will also be effected uniformly at those points of the distributing chamber which are farther removed from the feeder lines.

Advantageously, also individual or more feeder pipes with special feeder lines may be employed for adding other materials adapted to flow. In this connection, a division of the distributing chamber has proved advantageous so that in case of need it will be possible separately to add over different regions of the distributing chamber different materials adapted to flow such as an emulsion, a glue or a hardener.

Figure 1:
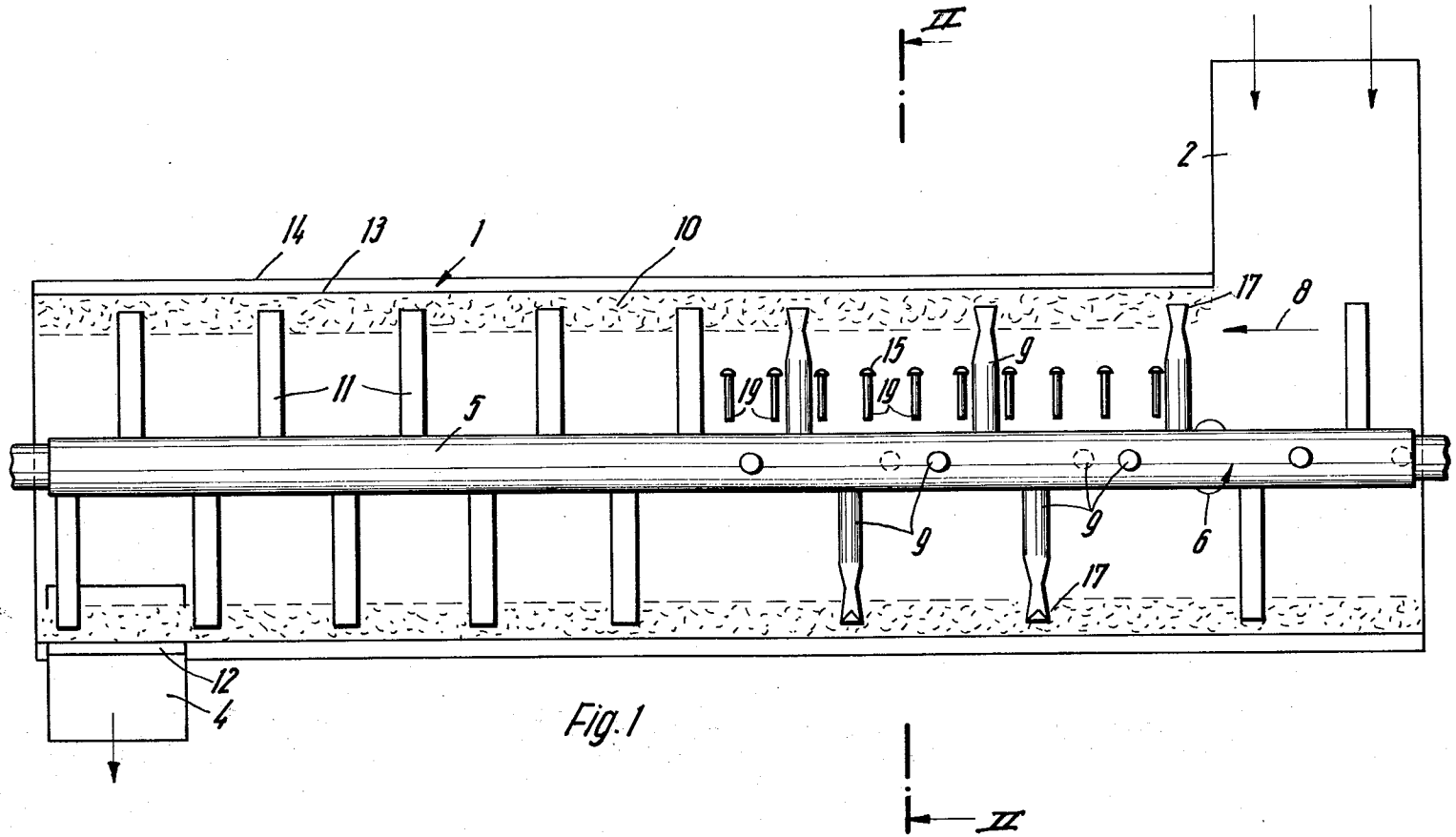

Referring now to the drawings in detail, the glue-applying machine diagrammatically illustrated in longitudinal section in FIG. 1 has a mixing chamber 1 on which at one end thereof there is provided an inlet chute 2 for the chip material while at the other end there is provided an outlet chute 4. Centrally located in the cylindrically designed mixing chamber 1 there is provided a mixing shaft 5 which is journalled at both ends and which rotates at high speed in the direction indicated by the arrow 6. The mixer shaft is at the inlet zone below the inlet chute 2 provided with two mixing tools 7 which convey the chip material received through the inlet chute 2 in the direction of the arrow 8 with a component parallel to the mixer shaft into the interior of the mixing chamber 1. Axially arranged thereto and mounted on the mixer shaft 5 are mixing tools 9 the design of which will be explained further below. These mixing tools 9 plow through the chip material ring 10 which forms on the inner wall of the drum due to the centrifugal force and which spirally moves in the direction toward the discharge chute 4 and subsequently moves into the region of the mixing tool 11. Above the discharge chute 4 there is provided a throttle 12 which is urged into closing position by a spring and permits a discharge of the material through the discharge chute 4 in conformity with the pressure of the material onto the inner wall of the drum-shaped mixing chamber. The mixing chamber is defined by a cylindrical wall 13 having associated therewith an outer wall 14 so that between the walls 13 and 14 an annular chamber is formed in which a cooling fluid flows.

Figures 2, 3, 4, 5:
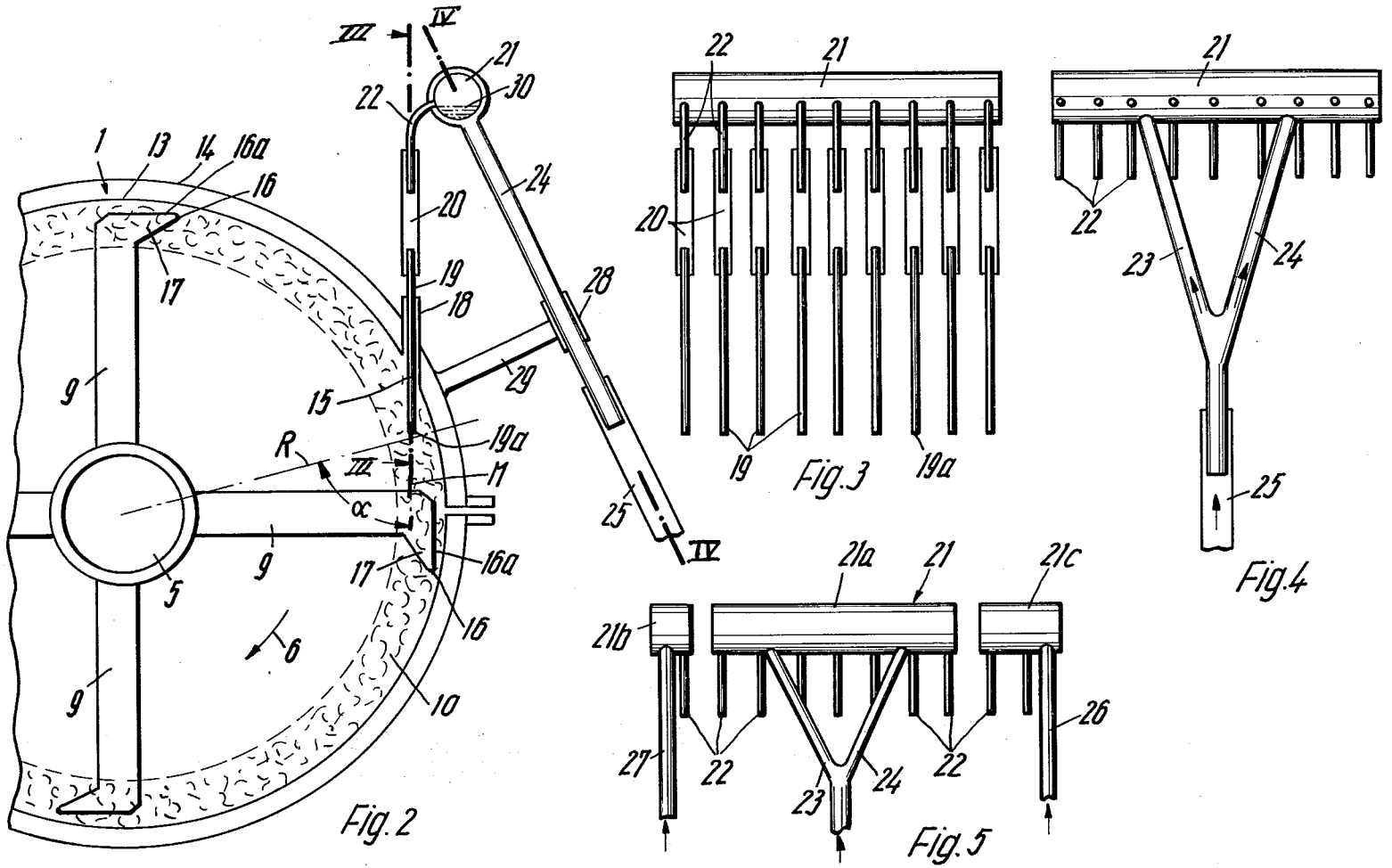
FIG. 2 represents a section taken along the line II — II of FIG. 1.
FIG. 3 represents a section taken along the line III — III of FIG. 2.
FIG. 4 illustrates a section taken along the line IV — IV of FIG. 2.
FIG. 5 illustrates a modified detail of FIG. 4.

As will be evident from FIG. 2, a passage 15 is formed in the wall 13 of the mixing chamber 1 through which passage glue may pass in a fluid flow into the interior of the mixing chamber 1. According to the specifically shown embodiment of FIG. 1, a plurality of passages 15 and thus of feeding stations for the glue are provided. The feeding of glue is effected within the region of the mixing tools 9 designed in the shape of boots (see FIGS. 6*a* and 6*b*). These mixing tools have a tip or nose 16 running ahead and a surface 16*a* which forms the sole of the boot. From the surface 16*a*, against the direction of rotation (arrow 6) two surfaces 17 extend toward the rear which are inclined toward each other in the manner of a roof. These surfaces act upon the chip material like a double plow blade and convey said material to both sides as well as in the direction toward the mixer shaft 5. The mixing material which is thus displaced to both sides (arrows 31 and 31*a* in FIG. 6) is moved toward the conduits 19 arranged on both sides and passes around said conduits and moves into the free space behind these conduits and the adjacent wall range of the inner wall 13 so that glue fluid which may be at these places is immediately moved away by the continuous back and forth movement of the material to be mixed. The arrows 31 in FIG. 6 show the flow lines of the material to be mixed which in view of the influence of the boot surfaces 17 passes around the conduits 19 from the rear. The arrows 31*a* indicate that material which passes the conduits 19 at the front side. The glue fundamentally be conveyed directly through the passage-like opening 15 in wall 13 of the mixing chamber 1. In this instance, it is advantageous to feed the glue directly radially outwardly of each mixing tool whereby the glue leaving the conduit 15 is wiped off and in view of the turbulence and the influence of the surfaces 17, is distributed over the chip material toward the interior as well as toward the sides. In order to assure a proper flow of the glue from the passages 15, the inflow direction should be inclined toward the direction of rotation of the chip material (arrow 6) so that a tangential inflow occurs and the glue is by the suction of the chip material pulled into the mixing chamber.

In the present embodiment, however, the cross section of the passages 15 is greater than the cross section for the passage of the necessary quantity of glue would have to be. The reason for this feature consists in that in the passages 15 there are arranged sleeves 18 in which the glue feeding conduits 19 are provided. The conduits 19 in their turn extend into the ring 10 of the chip material and more specifically preferably at least up to half the thickness of said ring while assuming maximum filling of the machine. With a normal dimensioning of the passages, this corresponds to approximately a distance of 30 millimeters from the wall 13 of the mixing chamber 1. As a result thereof, the glue is discharged approximately in the center of said ring 10, and it is avoided that the glue is discharged on the wall 13 of the mixing chamber 1. When employing the conduits 19, these conduits are advantageously arranged between the mixing tools 9 as shown in FIG. 1 while the uniform distribution of the glue is again aided particularly by the lateral movement of the chip material by the surfaces 17. The movement of the chip material in the direction away from the wall 13 of the mixing chamber 1 prevents a deposit of the glue on the wall of the mixing chamber. Advantageously, between each two adjacent conduits 19 there may be provided at least one mixing tool passing therethrough so that each conduit 19 is from both sides by means of the displacement surfaces 17 laterally acted upon by material to be mixed so that a continuous pulsating laterally oppositely directed flow around the conduits is obtained.

In case of need, naturally also a plurality of passages 15 and if desired, a plurality of glue feeding conduits 19 may be arranged within the region between two mixing tools 9. Such increased supply of glue may be employed in particular in the front region (viewed in the conveying direction of the chip material) of the glue applying zone which comprises the mixing tools 9. Two or more passages 15 of feeding conduits 19 may distributed over the circumferential direction be provided between two tools 9 and may also be arranged adjacent each other in axial direction.

The glue feeding conduits 19 are straight which fact not only facilitates the manufacture thereof but also their cleaning. The cleaning of these conduits is furthermore simplified by the fact that the conduits 19 can be removed from the sleeves 18. Furthermore, the supply to the conduits 19 and if desired, also directly to the passages 15 is effected by a connecting member 20 which is transparent and thus permits the observation of the flow of the glue during operation and also if impurities deposit or collect.

The charging of the glue conveying conduits 19 is according to an important feature of the invention effected through connection pieces 20 from a distributing tubular chamber 21 if so desired which through a connection 22 is connected to a connecting piece 20. The glue feeding conduits 19 or the passages 15 are arranged in the upper section of the mixing drum 1 while pointing downwardly and advantageously are standing upright so that the supply of the glue is aided by the suction of the ring 10 and also by the force of gravity. The connections 22 are advantageously arranged on the tubular distributing chamber 21 above the feeding pipes 23 and 24 whereby the uniform glue supply to the ring 10 will be assured because all connections 22 can be simultaneously charged when the glue level 30 has been reached. Furthermore, a glue dripping when the glue supply is turned off is limited to a minimum because the glue in the distributing chamber 21 is retained and can flow back through the pipe 23 and 24, the distributing chamber 21 in its turn is charged by feeder pipes 23 and 24 which in the specific example shown branch off in a fork-shaped manner from a central feeder pipe 25. The distance of the respective feeding line 23 or 24 from the individual connections 22 and the different flow resistance inherent thereto will not bring about a non-uniform supply of the connections 22 and thus of the glue feeding conduits 19 or passages 15.

In the embodiment according to FIG. 5, the distributing chamber 23 is divided into three parts 21*a*, 21*b* and 21*c*. The maximum central section 21*a* is as heretofore charged by the feeder pipes 23 and 24. One side portion 21*c* is charged through a separate feeder pipe 26 and the still smaller side part 21*b* through a likewise separate feeder pipe 27. In this way, the glue feeding conduits 19 may, if desired, be employed for a dosed addition of other substances which are adapted to flow such as an emulsion and a hardener. Of course, also all feeder pipes 23, 24, 26 and 27 may be charged with glue.

As will be evident from FIG. 2, the feeder pipes 23 and 24 and if desired also the feeder pipes 26 and 27 may be held by a sleeve 28 which is located relative to the outer wall 14 of the mixing chamber 1 by a supporting arm 29. In view of the inclined position of the pipes 23, 24, 26 and 27 inherent thereto, the substances flowing therein have to be lifted which fact in case of a plurality of feeder pipes which are charged together such as the pipes 23 and 24, brings about an always uniform distribution of the quantity of glue. In this way, it is assured that the distributing chamber 21 is supplied with glue uniformly over its length.

As indicated in the drawing, all feeding elements for the glue are placed one inside the other and are disengageable so that the entire glue feeding device can be removed from the mixing chamber 1 and can be dismantled into their individual parts. This simplifies the manufacture and also the servicing and purification considerably. In particular, when employing glue feeding conduits 19 in the passages 15, the glue is spaced sufficiently far from the inner wall 13 of the mixing chamber 1 and is so introduced into the chip material that a deposit of the glue on the wall of the mixing chamber can be safely avoided. The ends of the conduits 19 in ring 10 aid the mixing operation because they are fixedly arranged between the mixing tools 9 in the fast rotating ring 10 and thus contribute to the agitation of the particles of the chip material. In a typical case of employment, the mixing tools rotate at a slight distance of a few millimeters past the inner ends of the glue feeding conduits 19, and at a speed of rotation of approximately 1000 revolutions per minute so that the glue flowing off in a second through a conduit is by the mixing tools on both sides caught 35 times per second and in the ring 10 is by the lateral movement of the chip material intermixed. In this way, comparatively large quantities of glue can by the machine according to the invention be distributed at a high speed and homogeneously.

It is, of course, to be understood that the present invention is, by no means, limited to the specific showing in the drawings but also comprises any modifications within the scope of the appended claims.

What is claimed is:

1. A device for mixing glue with particulate material comprising an elongated, horizontal cylindrical mixing chamber having an inlet at one end and an outlet at the other end, said chamber having a glue applying zone at the end adjacent said inlet, a rotating shaft extending along the central longitudinal axis of said chamber, a plurality of axially spaced, radial arms extending from said shaft to adjacent the wall of said chamber for mixing material in said chamber upon rotation of said shaft, said rotating arms moving said material circumferentially in a path adjacent the wall of said chamber, a plurality of axially spaced glue feeding conduits in said glue applying zone extending adjacent the periphery within said chamber with their ends in the path of said material and opening in the forward direction of rotation of said material, each of said conduits being adjacent the path of one of said arms so that said arm moves the material laterally in passing the open end of the adjacent conduit to prevent accumulation of glue on the open end of said conduit, the rotation of said arms mixing said material and glue.

2. A device in combination according to claim 1 in which each said arm is widened in the axial direction at the radially outer end to cause lateral movement of the material in said chamber.

3. A device in combination according to claim 1 in which each said arm rotates between adjacent glue feeding conduits and has the radially outer end substantially boot shaped with the toe at the leading end and the heel at the trailing end and in substantially radial alignment with the respective arm.

4. A device in combination according to claim 3 in which each arm narrows in the axial direction inwardly from the radially outer end and has the narrowed cross section thereof near the material in the chamber.

5. A device in combination according to claim 1 which includes sleeves carried by said chamber and receiving said glue feeding conduits.

6. A device in combination according to claim 1 in which each glue feeding conduit includes a transparent section for observing the glue flow therein.

7. A device in combination according to claim 1 which includes a supply manifold connected to supply a plurality of said glue feeding conduits.

8. A device in combination according to claim 7 in which said manifold is tubular and is horizontally disposed, said glue feeding conduits pertaining to said manifold being distributed horizontally therealong.

9. A device in combination according to claim 7 which includes at least two main glue supply lines connecting to each manifold in spaced relation therealong.

10. A device in combination according to claim 9 which includes a primary glue supply conduit, said main glue supply lines branching off from a common connection to said primary supply conduit.

11. A device in combination according to claim 7 in which said glue feeding conduits are in the upper portion of said chamber and extend substantially vertically upwardly therefrom to said manifold.

12. A device in combination according to claim 7 which includes at least one glue supply line connected to the bottom of said manifold, said glue feeding conduits being connected to said manifold at a level above the bottom thereof.

13. A device in combination according to claim 7 which includes a glue supply line extending upwardly into said manifold for the supply of glue thereto.

14. A device in combination according to claim 7 in which said manifold and the said glue feeding conduits connected thereto are removeable from said device as a unit.

15. A device in combination according to claim 1 which includes further feeder conduits extending into said chamber for the supply of at least one other flowable substance to the material in said chamber.

16. A device in combination according to claim 1 which includes a plurality of separate glue supply manifolds, a group of said glue feeding conduits being connected to each manifold, and separate glue supply lines connected to supply glue to the individual manifolds.

17. A device in combination according to claim 1 in which the outlet end of each said glue feeding conduits is spaced radially inwardly from the peripheral wall of said chamber a distance on the order of about 30 millimeters.

18. A device for mixing glue with particulate material comprising an elongated, horizontal cylindrical mixing chamber having an inlet at end and an outlet at the other end, said chamber having a glue applying zone at the end adjacent said inlet, a rotating shaft extending along the central longitudinal axis of said chamber and having a plurality of axially spaced, radial arms extending from said shaft to adjacent the wall of said chamber, said arms moving said material in a circumferential path adjacent the wall of said chamber, a plurality of axially spaced, glue feeding conduits in said glue applying zone extending downwardly into said chamber adjacent its circumferential wall and opening into the path of said material with their open ends facing in the direction of forward motion of said material, each of said conduits being adjacent the path of one of the arms in the glue applying zone, each of said arms in said zone having an outer end adjacent the wall of said chamber projecting forwardly circumferentially from said radial arm to move the material inwardly from said wall, said end having inclined faces converging in the direction of movement of said arm to deflect the material axially as said arm rotates to move said material laterally in passing the open end of an adjacent conduit to prevent accumulation of glue on the end of said conduit.

* * * * *